United States Patent [19]

Oyama

[11] 4,188,695

[45] Feb. 19, 1980

[54] PANEL PROCESSING APPARATUS

[75] Inventor: Tadao Oyama, Mobara, Japan

[73] Assignee: Hitachi, Ltd., Japan

[21] Appl. No.: 879,755

[22] Filed: Feb. 21, 1978

[30] Foreign Application Priority Data

Jun. 3, 1977 [JP] Japan ..... 52/64796

[51] Int. Cl.[2] ..... H01J 9/42

[52] U.S. Cl. ..... 29/25.19; 29/25.15; 29/407; 316/27

[58] Field of Search ..... 29/25.13, 25.15, 25.19, 29/25.2, 468, 407; 83/63; 316/1, 27

[56] References Cited

U.S. PATENT DOCUMENTS

| | | | |
|---|---|---|---|
| 3,270,599 | 9/1966 | Kleist | 83/63 |
| 3,284,884 | 11/1966 | Prazale | 29/407 X |
| 3,482,286 | 12/1969 | Fassett et al. | 29/464 X |
| 3,513,736 | 5/1970 | Thorman | 83/63 X |
| 3,537,161 | 10/1970 | Kautz | 29/25.13 |

*Primary Examiner*—Richard B. Lazarus

*Attorney, Agent, or Firm*—Craig and Antonelli

[57] ABSTRACT

Apparatus for processing a panel for use with color television picture tubes including shadow mask mounting means for mounting a shadow mask on the panel, a processing station where various coatings are formed on the inner surface of the panel, shadow mask detaching means for removing the shadow mask from the panel, panel conveyor means, and shadow mask height variation detecting means for detecting variations in the height of different portions of the shadow mask with respect to the panel.

4 Claims, 7 Drawing Figures

PANEL PROCESSING APPARATUS

BACKGROUND OF THE INVENTION

This invention relates to a panel processing apparatus for use in the process of manufacture of color television picture tubes including means for automatically fitting a shadow mask in a panel and means for detecting the condition in which the shadow mask is fitted in the panel.

In the process for manufacture of color television picture tubes, a coating of black matrix, coatings of phosphors and a coating of an emulsion are applied to the inner surface of each panel by following a plurality of coating steps, after a coating of a photo-resist is formed on the inner surface of the panel by applying the photo-resist thereto and then exposing the photo-resist layer to a light source through a shadow mask. In applying these coatings by following the plurality of coating steps, predetermined operations are successively performed in sequence without interruption and mounting and detaching of the shadow mask in and from the panel are frequently effected repeatedly when the operation shifts from one step to another. In order to automatically perform these coating operations, it is necessary to continuously convey the workpieces in the production line. When a series of operations are continuously performed, almost all the panels in the production line will become unacceptable for specifications if trouble arises and the movement of the workpieces is stopped. Therefore, it is essential, from the point of view of increasing efficiency in production, that either the movement of the workpieces not be stopped or the normal condition be restored to the production line as soon as possible once the movement of the workpieces in the production line is stopped.

One problem encountered in such apparatus and causing trouble is that a shadow mask may not be fitted completely in a panel in the step of fitting the shadow mask in the panel due, for example, to variations in the sizes of the shadow mask and the panel. For example, the shadow mask may be fitted in the panel in what is referred to as two-pin mounting in which only two of more than three pins of the panels engage the shadow mask or in what is referred to as one-pin mounting in which only one pin of the panel engages the shadow mask. In such a case, the shadow mask tilts and projects from the panel sealing surface because the rest of the pins do not engage the shadow mask.

This problem results in the shadow mask interfering with the operation of shadow mask mounting means or panel conveyor means, thereby stopping the movement of the workpieces or causing damage to the apparatus.

SUMMARY OF THE INVENTION

A primary object of the present invention is to provide a panel processing apparatus which is capable of increasing efficiency in manufacturing color television picture tubes by detecting incomplete mounting of a shadow mask in a panel and taking necessary steps to cope with the situation without stopping the movement of the workpieces in the production line, in case such misoperation occurs.

Another object of the present invention is to provide a panel processing apparatus comprising shadow mask height variation detecting means which is operative while coating steps are being followed for applying various coatings to the inner surface of a panel, so that variations in the height of different portions of a shadow mask caused by incomplete mounting in the shadow mask in the panel by shadow mask mounting means can be detected and the assembly of such shadow mask and panel can be withdrawn from the production line without stopping the movement of the workpieces in the line.

Still another object is to provide a panel processing apparatus which can have application not only in the station posterior to the shadow mask mounting means but also in any subsequent stations, so that incomplete fitting of a shadow mask in a panel can be detected although detection of the phenomenon may be delayed.

In the novel panel processing apparatus provided by the invention, a shadow mask incompletely fitted in a panel is detected and the assembly of such shadow mask and panel is removed from the coating steps. The outstanding characteristic of the invention is that the panel processing apparatus comprises panel height variation detecting means mounted in a station for performing coating steps for detecting variations in the height of different portions of the shadow mask when the shadow mask is incompletely fitted in the panel by shadow mask mounting means, and removing the assembly of such shadow mask and panel from the line. By virtue of this novel feature of the invention, it is possible to automatically cope with incomplete fitting of the shadow mask in the panel without stopping the movement of the workpieces in the line, thereby increasing efficiency in the manufacture of color television picture tubes.

DESCRIPTION OF THE PREFERRED EMBODIMENT

Figure 1:
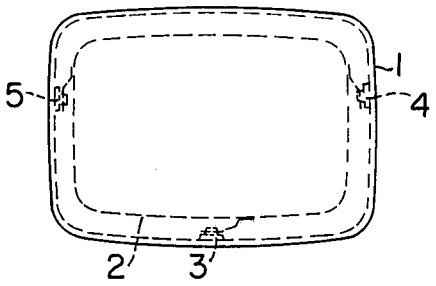
FIG. 1 is a plan view showing a panel having a shadow mask fitted therein.
Figure 2:
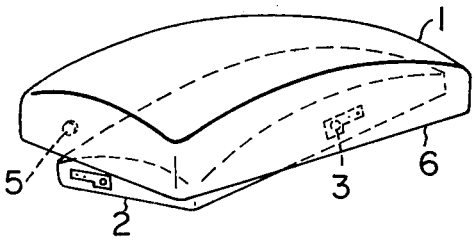
FIGS. 2, 3 and 4 are perspective views of the panel and the shadow mask of FIG. 1, with the shadow mask being engaged by only two pins of the panel and consequently disposed in an inclined position.
Figure 3:
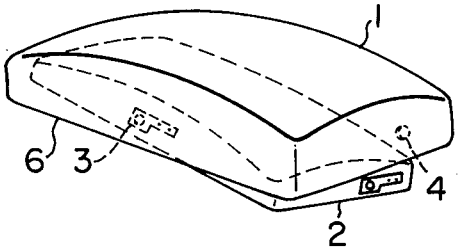
Figure 4:
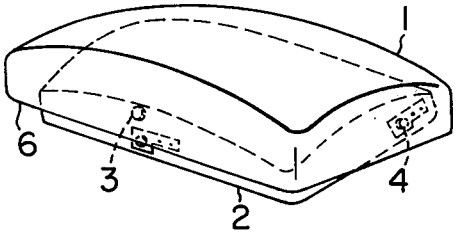

Referring to FIGS. 1 to 4, there are shown a panel 1 and a shadow mask 2 fitted in the panel 1 in various different conditions. The shadow mask 2 is mounted correctly in the panel 1 in the condition shown in FIG. 1. When this is the case, the shadow mask 2 is engaged by three panel pins 3, 4 and 5 of the panel 1 and disposed horizontally. FIGS. 2, 3 and 4 each show the assembly of the panel 1 and the shadow mask 2 in which the latter is incorrectly fitted in the former as in so-called two-pin mounting in which the shadow mask 2 is engaged by only two panel pins and the rest of the panel pin remain idle. In FIG. 2, the shadow mask 2 is shown as being engaged by panel pins 3 and 4 in being fitted in the panel. FIG. 3 shows the shadow mask 2 as being engaged by the panel pins 3 and 5, and FIG. 4 shows the shadow mask 2 as being engaged by the panel pins 4 and 5.

Figure 5:
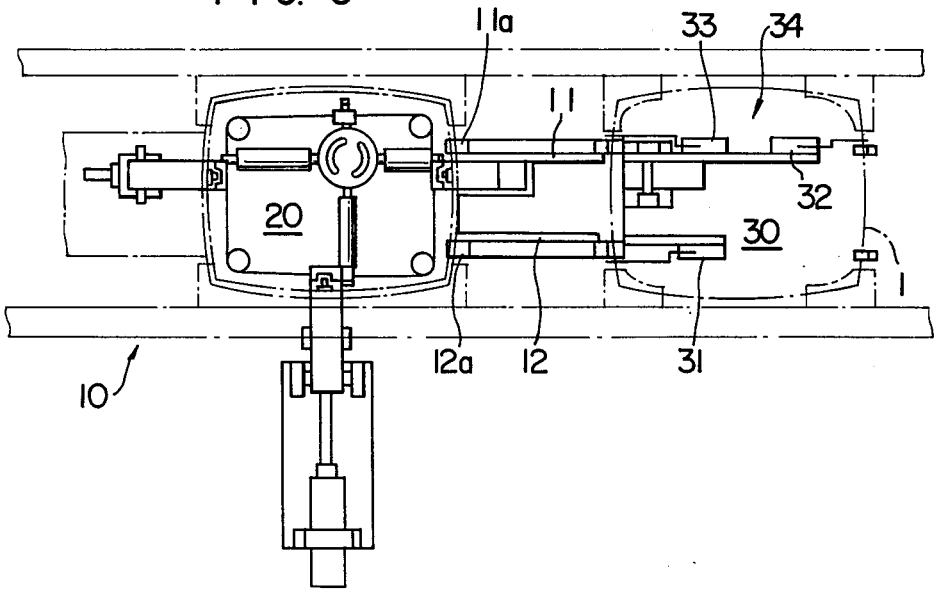
FIG. 5 is a plan view of the panel processing apparatus comprising one embodiment of the invention.
Figure 6:
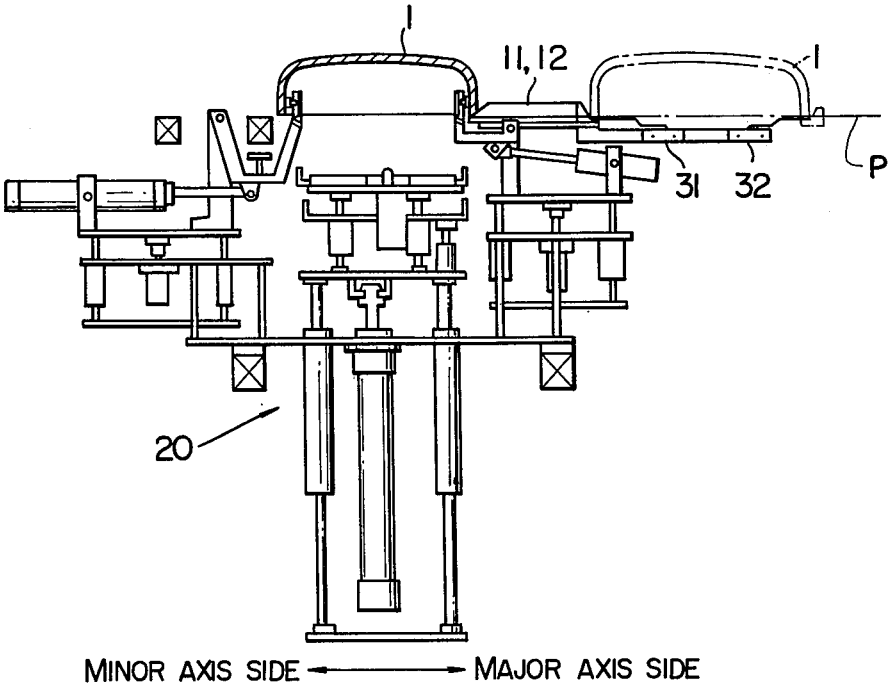
FIG. 6 is a front view of the apparatus shown in FIG. 5.

If the shadow mask 2 is fitted in the panel in two-pin mounting as shown in FIGS. 2 to 4, the shadow mask 2 will not be disposed horizontally and will become inclined with the result that variations will occur in the height of the underside of different portions of the shadow mask 2 and a portion of the shadow mask 2 will project from a panel sealing surface 6. The shadow mask 2 fitted in the panel in these conditions has the risk of interfering with the operation of panel conveyor means 10 shown in FIGS. 5 and 6 and stopping its movement or damaging the same when the incompletely fitted assembly of the panel and shadow mask is conveyed by the panel conveyor means to the next following processing station.

According to a preferred embodiment in accordance with the invention, there is provided a detecting station 30 between shadow mask mounting means 20 and the next following processing station. In the detecting station 30, there is mounted panel height variation detecting means 34 comprising three limit switches 31, 32 and 33 for detecting variations in the height of three different points of the shadow mask 2 caused by the inclination of the shadow mask 2 as shown in FIGS. 2–4. The shadow mask height variation detecting means 34 detects any assembly of the panel 1 and the shadow mask 2 which has dimensions deviating from normal ones, and such assembly is withdrawn from the line by being transferred by panel transfer means (not shown) to a predetermined position, so that the movement of the workpieces in the line will not stop at all.

Arranged between the shadow mask mounting means 20 and the detecting station 30 of the next following stage are guides 11 and 12 having tapered end portions 11*a* and 12*a* respectively. Again with reference to the inclined shadow mask arrangement of FIGS. 2–4, when the panel 1 and the shadow mask 2 are conveyed by the panel conveyor means 10 to the detecting station 30 after the shadow mask 2 is fitted in the panel 1, the guides 11 and 12 move the shadow mask 2 upwardly. The tapered end portions 11*a* and 12*a* perform the function of preventing dislodging of the shadow mask 2 from the panel 1 which might otherwise be caused by impact on the assembly while being conveyed due to the fact that the guides are mounted as shown, at a height beginning at the top plane P of the apparatus and any depending portions of the shadow masks coming against tapered portions 11*a*, 12*a* will slide upwardly therealong.

Figure 7:
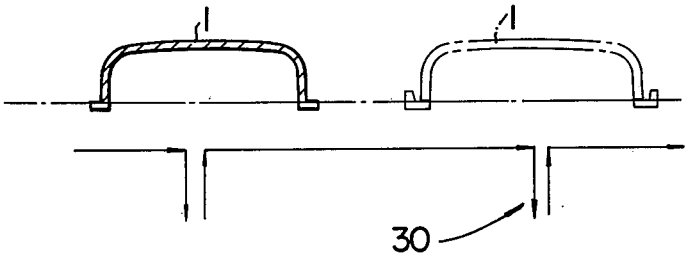
FIG. 7 is a front view of the panel conveyor means, briefly showing its operation.

The panel conveyor means 10 for conveying the panel 1 includes a shuttle conveyor which operates in such a manner that it moves upwardly, horizontally and downwardly in the indicated order as shown in FIG. 7. If the distance covered by the upward movement of the shuttle conveyor is greater than a certain level, the guides 11 and 12 can be eliminated. However, in this case, there is a disadvantage of the conveying cycle of the panel 1 becoming long. Therefore, it is considerably advantageous to reduce the distance covered by the upward movement of the shuttle conveyor and use the guides 11 and 12 with the shuttle conveyor.

In the embodiment described hereinabove, the guides 11 and 12 for moving the shadow mask 2 upwardly are used and variations in the height of different portions of the shadow mask 2 are detected in the detecting station 30 at the next stage. It is to be understood, however, that the invention is not limited to the aforesaid specific structure as photo-switches in a station in which the shadow mask mounting means 20 is located can be used. Also, similar results can be obtained by using proximity switches as means for detecting variations in the height of different portions of the shadow mask.

While the invention has been described by referring to an embodiment in which a panel is the object to be handled, it is to be understood that the invention can have application in any container or article which in concave in shape and has reference pins corresponding to the aforesaid panel pins. Also, in the embodiment shown and described, the panel has been described as having three panel pins, but the invention also can have application in a panel of four-pin construction.

I claim:

1. In a panel processing apparatus including
means for mounting a shadow mask on a panel; and
panel conveyor means;
the improvement comprising:
shadow mask height variation detecting means for detecting variations in the height of different portions of the shadow mask caused by improper mounting of shadow mask on said panel, said panel conveyor means being operable to transfer a panel with an at least partially mounted shadow mask from said mounting means onto said detecting means.

2. A panel processing apparatus as claimed in claim 1 wherein said shadow mask height variation detecting means comprises a plurality of switches selected from the group consisting of photo-switches, limit switches and proximity switches.

3. In a panel processing apparatus including
means for mounting a shadow mask on a panel;
panel conveyor means;
the improvement comprising
shadow mask height variation detecting means for detecting variations in the height of different portions of the shadow mask caused by improper mounting of said shadow mask on said panel and mounted along said panel conveyor means downstream relative to said means for mounting; and
guide means interposed below said shadow mask mounting means and said shadow mask height variation detecting means for upwardly moving a shadow mask improperly inclined relative to said panel so as to have a portion extending below said panel, whereby impacting of said shadow mask on said apparatus is prevented.

4. A panel processing apparatus as claimed in claim 3 wherein said shadow mask height variation detecting means comprises a plurality of switches selected from the group consisting of photo-switches, limit switches and proximity switches.

* * * * *